US007101027B2

(12) United States Patent
Iijima et al.

(10) Patent No.: US 7,101,027 B2
(45) Date of Patent: Sep. 5, 2006

(54) INKJET PRINTER

(75) Inventors: Shota Iijima, Nagoya (JP); Mutsuo Fukuoka, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 223 days.

(21) Appl. No.: 10/768,000

(22) Filed: Feb. 2, 2004

(65) Prior Publication Data

US 2004/0227792 A1 Nov. 18, 2004

(51) Int. Cl.
*B41J 2/175* (2006.01)
*B41J 1/185* (2006.01)

(52) U.S. Cl. ..... 347/85; 347/90
(58) Field of Classification Search ..... 347/31, 347/49, 85, 86, 90
See application file for complete search history.

(56) References Cited

U.S. PATENT DOCUMENTS 4,878,069 A * 10/1989 Kiyohara ..... 347/86
6,164,770 A 12/2000 Takata

FOREIGN PATENT DOCUMENTS

JP A 11-58762 3/1999

* cited by examiner

*Primary Examiner*—Anh T. N. Vo
(74) *Attorney, Agent, or Firm*—Oliff & Berridge, PLC

(57) ABSTRACT

An inkjet printer in which an ink cartridge is allowed to communicate with a recording head through a hollow needle member when the ink cartridge is thrust and attached into a body casing. In a support member of the body casing which supports the ink cartridge, an ink outlet having a concave shape open at the top is provided in a position vertically under the needle member. An ink absorber is provided on at least the bottom surface of the ink outlet.

16 Claims, 10 Drawing Sheets

INKJET PRINTER

BACKGROUND OF THE INVENTION

1. Field of the Invention

The present invention relates to an inkjet printer, and particularly relates to an inkjet printer in which ink in an ink cartridge is supplied to a recording head through a needle member.

2. Description of the Related Art

There has been hitherto known an inkjet printer in which an exchangeable ink cartridge is attached into a main body of the inkjet printer, and ink in the ink cartridge is supplied to a recording head through a hollow needle member, as disclosed in JP-A-Hei.11-58762 and the like.

According to JP-A-Hei.11-58762, a recording head for ejecting ink to thereby perform recording on a recording medium such as a sheet of paper is mounted on a carriage provided movably forward and backward in the width direction of the recording medium. An ink cartridge mounting portion where an ink cartridge for supplying ink to the recording head will be removably attached is provided on the carriage. A hollow needle member is provided in the cartridge mounting portion. Then, when the ink cartridge is attached to the cartridge mounting portion, the needle member is thrust into the ink cartridge so that the ink is guided to an ink channel through the needle member and supplied to the recording head.

SUMMARY OF THE INVENTION

However, according to JP-A-Hei.11-58762, the ink cartridge is exchangeable. Therefore, the ink cartridge is removed from the needle member when ink in the ink cartridge has run out or when the ink cartridge is removed and attached for some reason. Thus, the needle hole of the hollow needle member, which has introduced ink from the ink,cartridge into the recoding head till then, is opened. As a result, ink received in the needle member leaks out from the needle hole, and brings pollution to the carriage or the main body of the inkjet printer. Furthermore, the ink may be attached to the user himself/herself or the recording paper. A solution to this problem has been demanded.

In addition, according to JP-A-Hei.11-58762, the recording head and the needle member (the position where the ink cartridge should be attached) are disposed together on the carriage. In some configuration of the inkjet printer, these are not always disposed together on the carriage. The recording head may be disposed at a position higher than the needle member. Particularly in such a case, head pressure is applied to the needle member due to a head liquid difference between the needle member and the nozzle surface of the recording head. As a result, when a cap covering the nozzle surface of the recording head is removed in a state where the ink cartridge has been removed from the needle member, all the ink in the ink channel extending from the recording head at a higher level to the needle member at a lower level leaks out from the needle hole. Thus, the pollution with the ink is an extremely large problem.

In consideration of the foregoing problems, it is an object of the invention to solve pollution with ink in an inkjet printer. Particularly, it is another object of the invention to provide an inkjet printer in which it is possible to prevent pollution with ink flowing out when an ink cartridge is removed from a needle member.

According to an embodiment of the invention, an inkjet printer includes a body casing, a recording head, an ink cartridge, a hollow needle member, a support member, and an ink absorber. The recording head ejects ink to perform recording on a recording medium. The ink cartridge stores ink to be supplied to the recording head and is attached to the body casing. The hollow needle member is provided in the body casing and allows the ink cartridge and the recording head to communicate with each other when the ink cartridge is thrust and attached to the body casing. The support member supports the ink cartridge of the body casing. The support member defines an ink outlet at least just below the needle member. The ink absorber is disposed at least on a bottom surface of the ink outlet.

With this configuration, ink leaking from the needle member enters the ink outlet provided at least just below the needle member, and is absorbed and retained in the ink absorber disposed in the ink outlet. Accordingly, the ink is prevented from flowing into the support member or another member and thereby polluting the inkjet printer.

BRIEF DESCRIPTION OF THE DRWAINGS

DETAILED DESCRIPTION OF THE PREFERRED EMBODIMENT

Next, an embodiment of the invention will be described below.

Figure 1:
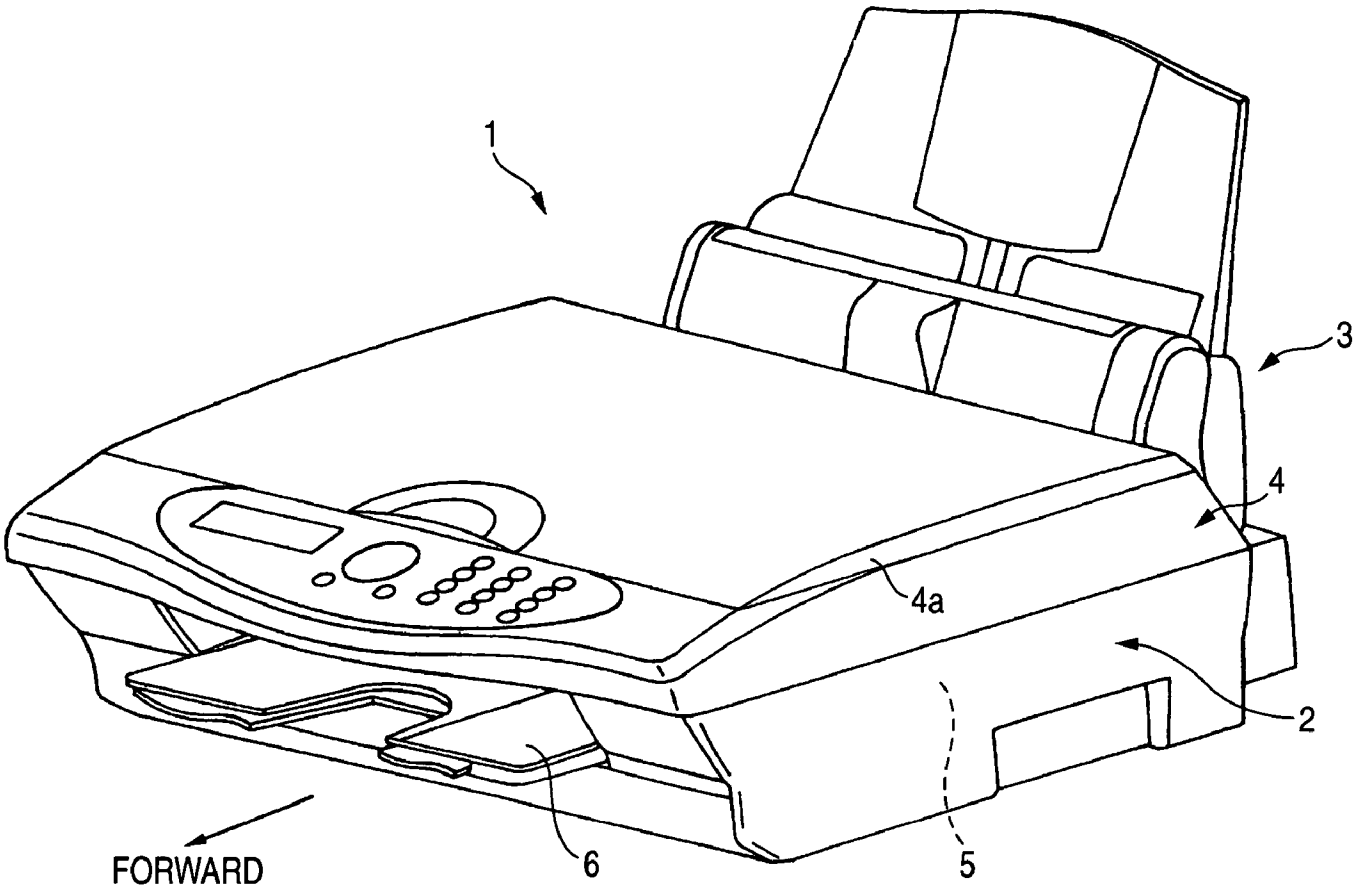
FIG. 1 is a view of an external appearance of a multi function device having an inkjet head according to an embodiment of the invention.

In this embodiment, the invention is applied to a multi function device 1 having a printer function, a copying function, a scanner function and a facsimile function. As shown in FIG. 1, a paper supply unit 3 is provided on the rear side of a body casing 2 of the multi function device 1. A document reading unit 4 for the copying function and the like is provided on the top side of the multi function device 1 in front of the paper supply unit 3. An inkjet printer 5 (which will be described later) for implementing the printer function and the like is provided under the document reading unit 4. A paper delivery tray 6 for receiving recording media such as sheets of paper P recorded (printed) thereon and discharged is provided in front of the inkjet printer 5.

Though not shown, the document reading unit 4 is designed to be able to swing up/down in accordance with a horizontal shaft at its rear end portion. When a cover 4*a* is opened upward, a mounting glass plate for mounting a document thereon is provided, and an image scanner unit for reading the document is provided under the mounting glass plate.

Figure 2:
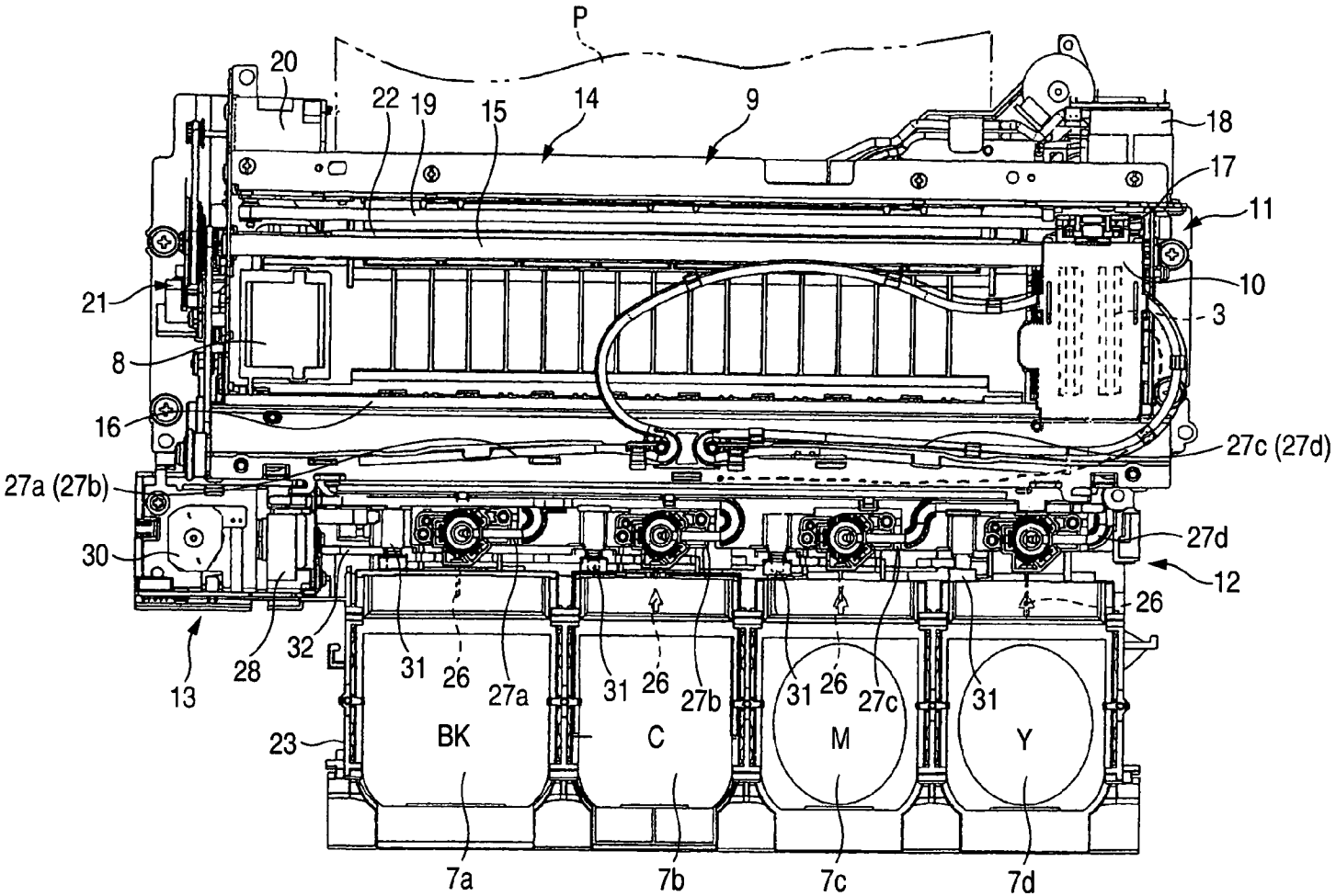
FIG. 2 is a plan view of an inkjet printer in a state in which a document reading unit has been removed from the multi function device depicted in FIG. 1.

When the document reading unit 4 as a whole is opened upward, ink cartridges 7 (including ink cartridges 7*a* to 7*d* for individual colors, that is, black, cyan, magenta and yellow with reference to FIG. 2) serving as ink tanks can be exchanged for use in the inkjet printer 5 for full-color recording, that is, maintenance can be performed with respect to a recording head unit 10.

Next, with reference to FIGS. 2 to 5, description will be made on the schematic configuration of the inkjet printer 5. The inkjet printer 5 includes a printing mechanism portion 9, a maintenance unit 11, an ink supply portion 12, and an air supply portion 13. The printing mechanism portion 9 is enclosed in a body frame 14 and ejects ink onto a sheet of paper P as a recording medium to thereby perform recording on the sheet of paper P. The maintenance unit 11 performs maintenance processing for the recording head unit 10 in the printing mechanism portion 9. The ink supply portion 12 supplies inks from the ink cartridges 7*a* to 7*d* to the recording head unit 10. The air supply portion 13 supplies compressed air (of positive-pressure) to the ink cartridges 7*a* to 7*d*.

Figure 3:
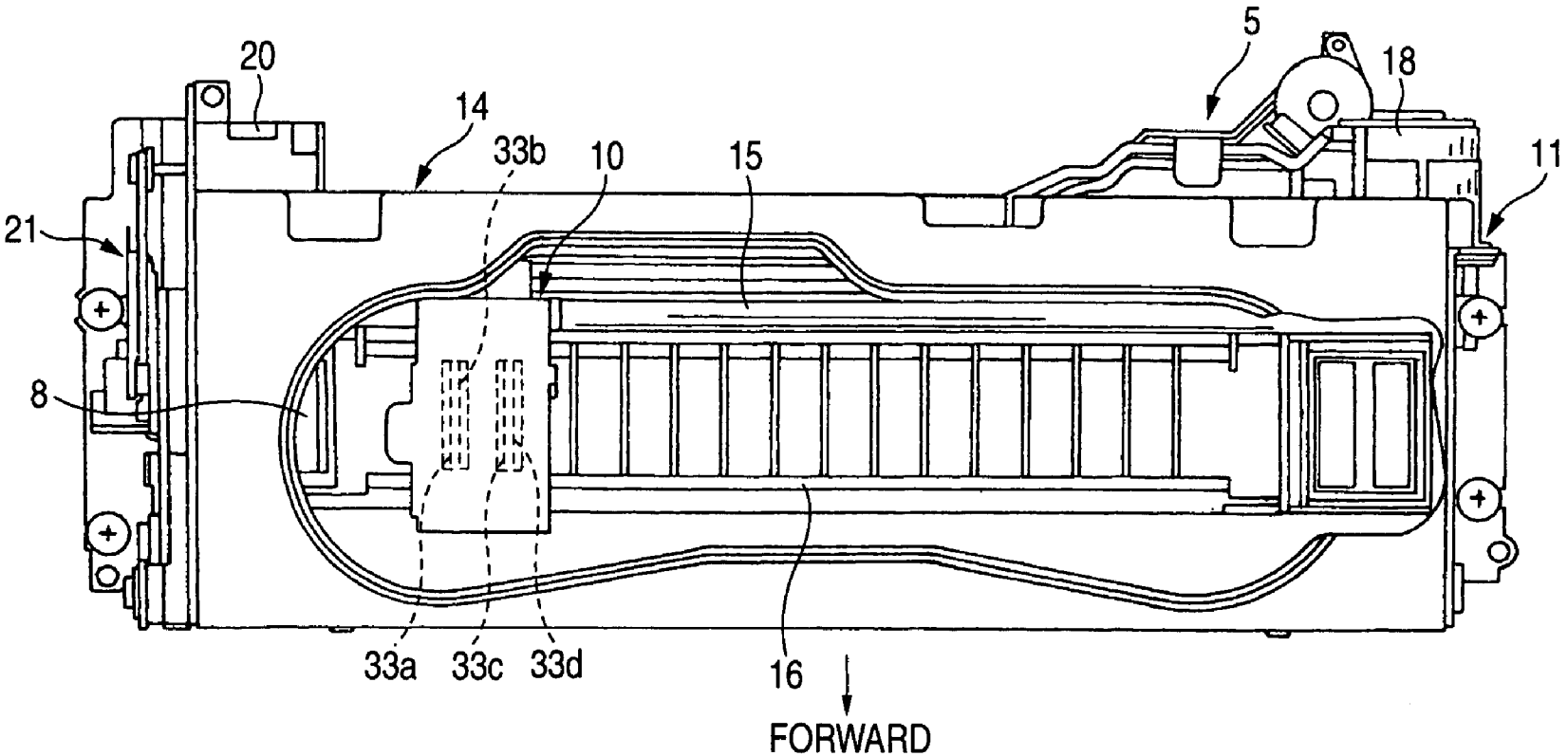
FIG. 3 is a plan view showing the periphery of a recording head unit of the inkjet printer.
Figure 5:
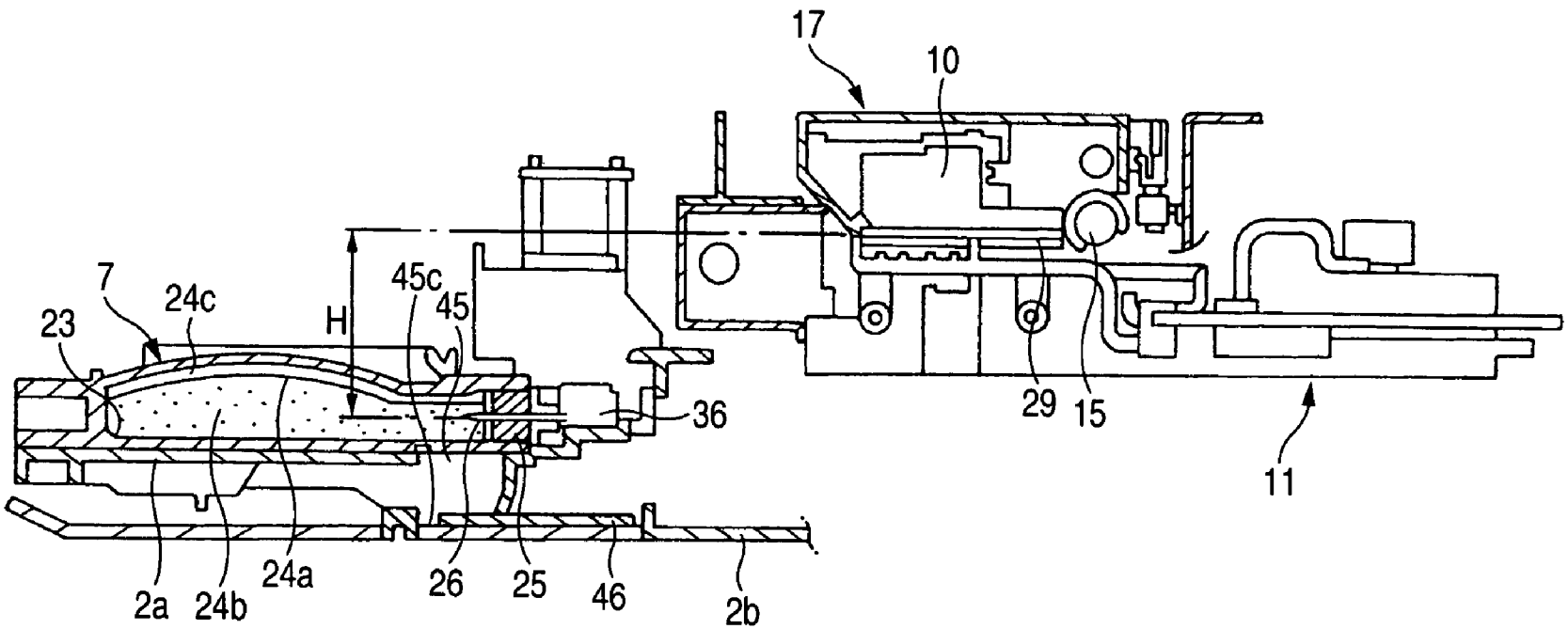
FIG. 5 is a longitudinally sectional view showing the positional relation between a nozzle surface and an ink needle.

The printing mechanism portion 9 and the maintenance unit 11 are received in the box-like body frame 14 opened like a substantially elliptic shape at the top as shown in FIGS. 2, 3 and 5. A carriage 17 is mounted slidably on rear and front guide shafts 15 and 16, which are provided in parallel in the body frame 14 and have lengths in the left/right direction. The recording head unit 10 is attached and mounted integrally onto the carriage 17.

The carriage 17 can be moved forward and backward in the left/right direction along the front and rear guide shafts 16 and 15 by a carriage drive motor 18 and a timing belt 19 (see FIG. 2). The carriage drive motor 18 is disposed on the right rear side of the body frame 14. The timing belt 19 is an endless belt. On the other hand, a main feed roller 22 and a feed roller (not shown) located under the front guide shaft 16 transport the sheet of paper P horizontally on the lower surface side of the recording head unit, through a feed motor 20 and a transmission mechanism 21. Thus, the sheet of paper P on which recording has been performed is transported and discharged to the paper delivery tray 6. The feed motor 20 is disposed on the left rear side of the body frame 14. The transmission mechanism 21 includes a belt and gears and is disposed on the left side of the main frame 14. The main feed roller 22 is disposed under the rear guide shaft 16.

Outside the width of the sheet of paper P to be transported, an ink reception portion 8 is provided on one end side thereof (left end portion in FIGS. 2 and 3 in this embodiment), and the maintenance unit 11 is disposed on the other end side. Thus, ink ejection by the recording head unit 10 for preventing nozzles from clogging is performed periodically during recording operation and at a flushing position where the ink reception portion 8 is provided. The ink reception portion 8 receives the ejected ink. At the head waiting position on the other end side, the maintenance unit 11 disposed there performs cleaning of the nozzle surface, and performs recovery processing or the like for sucking ink selectively for each color.

Next, with reference to FIG. 3, description will be made on the configuration of the recording head unit 10 mounted on the carriage 17. In this embodiment, the recording head unit 10 for full-color recording includes recording heads (not shown, four heads in the embodiment) having nozzle arrays for their corresponding colors respectively, and flat-sheet-like actuators (not shown) such as piezoelectric devices bonded to the top surfaces of the recording heads respectively.

On the lower surfaces of the recording heads., an array of nozzles 33*a* for black (BK), an array of nozzles 33*b* for cyan (C), an array of nozzles 33*c* for magenta (M) and an array of nozzles 33*d* for yellow (Y) are formed in that order from the left in FIG. 3 so as to be long in a direction perpendicular to the moving direction of the carriage 17. Then, the respective nozzles 33 are exposed downward so as to face the top surface of the sheet of paper P. In the same manner as a known one, each recording head distributes supplied ink to a pressure chamber for each nozzle and ejects the ink from the nozzle by means of an actuator such as a piezoelectric device corresponding to the pressure chamber.

Figure 4:
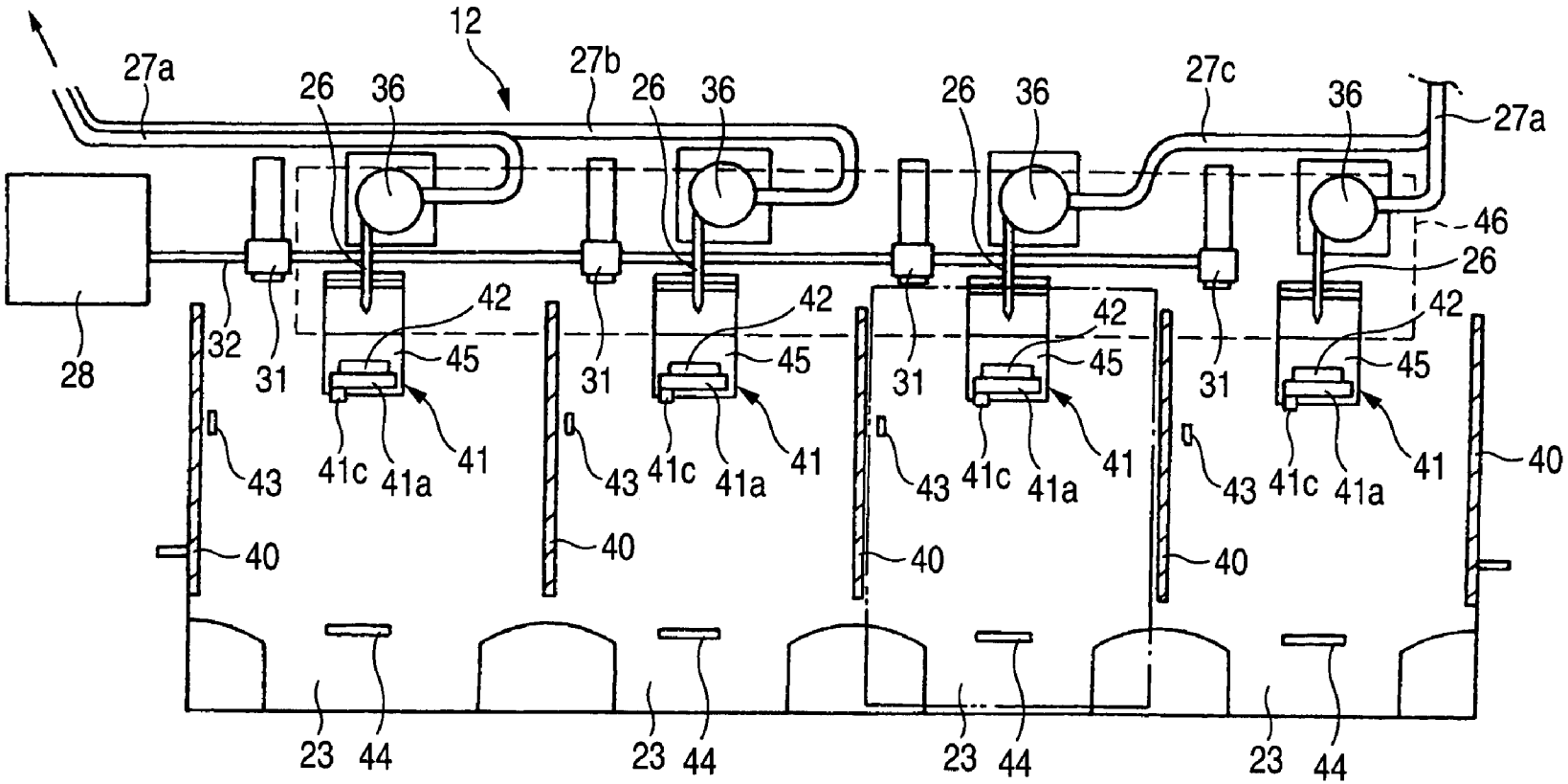
FIG. 4 is a plan view showing the periphery of a cartridge mounting portion.

Next, description will be made on the configuration of the ink supply portion 12. As shown in FIGS. 2, 4 and 5, under the feed path of the sheet of paper P and on the front side of the top surface of a lower partition plate 2*a* (see FIG. 5) of the body casing 2, cartridge mounting portions 23 to which the ink cartridges 7 for individual colors can be inserted and attached from the front respectively are provided under a nozzle surface 29 on the lower surface of the recording head unit 10. In FIG. 2, the ink cartridge 7*a* for black (BK), the cartridge 7*b* for cyan (C), the cartridge 7*c* for magenta (M) and the cartridge 7*d* for yellow (Y) are disposed horizontally and in parallel in that order from-the left.

A film material 24*a* having flexibility is pasted substantially all over the region in each ink cartridge 7. The ink cartridge 7 is divided into a lower ink reception chamber 24*b* and an upper air chamber 24*c* by the film material 24*a*.

In the surface of each ink cartridge 7 (hereinafter referred to as "insertion-sidewall surface of the ink cartridge 7") approaching the rear side of the multi function device 1 when the ink cartridge 7 is attached, an air hole (not shown) communicating the air chamber 24*c* with the atmosphere is provided on the other hand, a seal member 25 made of silicone or the like is attached to divide the ink reception chamber 24*b* from the outside.

An ink needle 26 is provided at the rear of each cartridge mounting portion 23 so as to project horizontally and to substantially face the center of the insertion-side wall surface of the ink cartridge 7 of the corresponding color. Each ink needle 26 is hollow, and a needle hole 26*a* is formed in the side surface close to its tip. When the ink cartridge 7 is attached to the cartridge mounting portion 23, the ink needle 26 is inserted into the seal member 25 of the ink cartridge 7, and the needle hole 26*a* of the ink needle 26 reaches the inside of the ink reception chamber 24*b*. The base end portion of the ink needle 26 corresponding to each color ink is connected to a corresponding ink supply tube 27*a*–27*d* having flexibility through a buffer tank 36 so as to supply the ink to the recording head unit 10. In this case, the ink supply tubes 27*a* and 27*b* for black and cyan are bundled in their halfway portions so as to overlap each other above and below, and the ink supply tubes 27*c* and 27*d* for magenta and cyan are also bundled in the same manner. Each buffer tank 36 once holds the ink supplied from the corresponding ink needle 26, and filters out rubbish in the ink.

Here, as shown in FIG. 5, each nozzle surface 29 in the recording head unit 10 is disposed in a position higher than a position of the corresponding ink needle 26 by a head H. Then, four pressure-contact pads 31 provided to project forward in parallel with the ink needles 26 respectively are connected to an air pump 28 of a diaphragm type or the like in the air supply portion 13 through an air tube 32. The pressure-contact pads 31 are retained by the urging force of urging springs so as to be in close contact with air holes of the insertion-side wall surfaces of the ink cartridges 7 fixedly inserted into the cartridge mounting portions 23 respectively. In this state, for example, at the time of maintenance operation, the air pump 28 is driven by a drive motor 30 so as to supply compressed (positive-pressure) air to the air chambers 24*c* of the ink cartridges 7*a* to 7*d* to thereby provide positive pressure to the inks in the ink reception chambers 24*b* respectively. Thus, any meniscus can be prevented from being broken when the cap is detached from the nozzle surface of the recording head unit 10.

Next, description will be made further in detail on the cartridge mounting portions 23. As shown in FIG. 4, each cartridge mounting portion 23 includes a partition 40, a shutter member 41, a lock member 42 of the shutter member 41, an unlocking operation piece 43, a shelter port 45 of the shutter member 41, and a detachment preventing lock protrusion portion 44. The partition 40 is provided to guide the ink cartridge 7. The shutter member 41 is provided to shield the ink needle 26. The detachment preventing lock protrusion portion 44 is provided to prevent detachment of the ink cartridge 7.

The partitions 40 are formed on the opposite sides of each cartridge mounting portion 23 so as to project upward from the surface of the lower partition plate 2*a* of the body casing 2 and extend in the depth direction thereof Thus, the partitions 40 define the width of the cartridge amounting portion 23. The ink cartridges 7 are formed so that only the black ink cartridge 7*a* used very often is wider than any other ink cartridge 7*b*–7*d*. Accordingly, each interval between the partitions 40 is made as large as the width of the corresponding ink cartridge 7.

Figure 7:
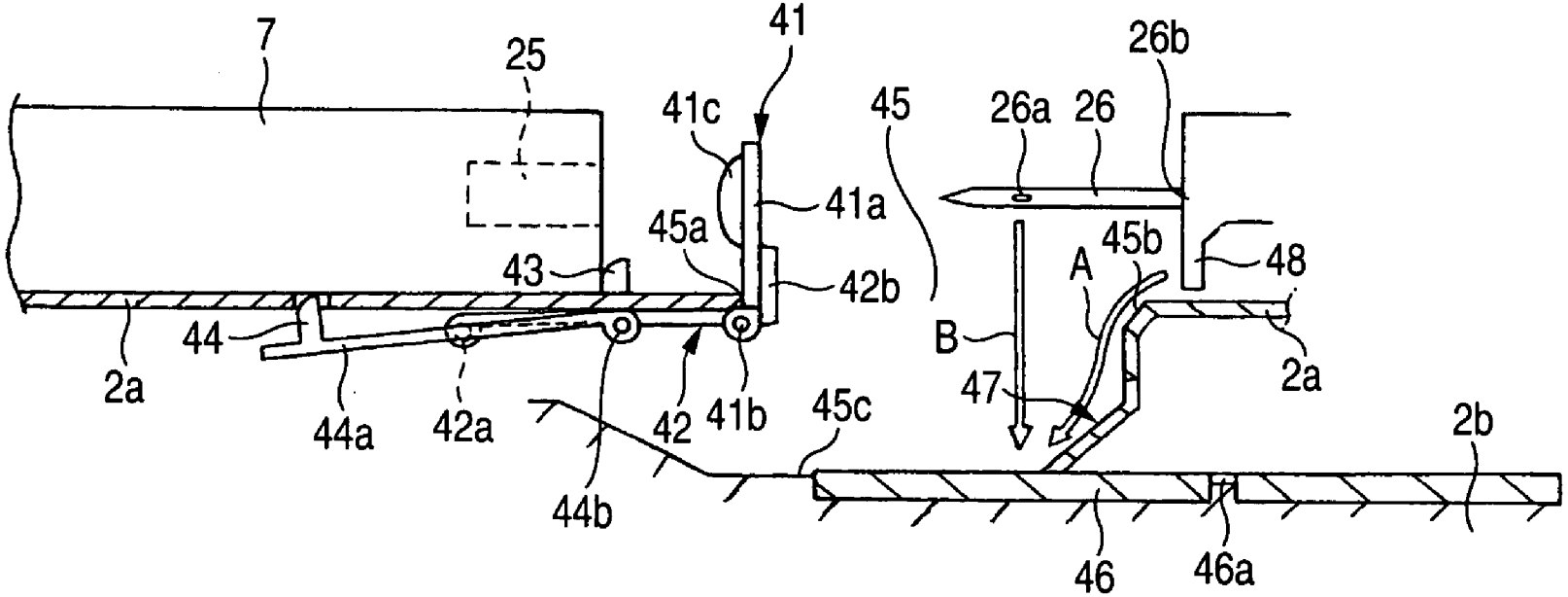
FIG. 7 is a longitudinally sectional view showing the state where the ink cartridge is being attached to the cartridge mounting portion.

The shutter member 41 is located on the tip side of the ink needle 26 and at a distance therefrom so as to cover the tip of the ink needle 26 from the front side of the cartridge mounting portion 23. As shown in FIG. 7, the shutter member 41 includes a shutter face portion 41*a* for shielding the front of the ink needle 26 when the ink cartridge 7 is absent. The shutter face portion 41*a* is supported under the lower partition plate 2*a* rotatably around a rotating shaft 41*b* of the shutter member 41 crossing the depth direction at right angles. Then, the shutter face portion 41*a* can swing between a shield position where the shutter face portion 41*a* projects from the shelter port 45 formed in the lower partition plate 2*a* so as to rise on the lower partition plate 2*a* and a shelter position where the shutter face portion 41*a* falls down to take shelter into the shelter port 45. The shutter face portion 41*a* is always urged toward the shelter position by a not-shown spring. In addition, a spacer portion 41*c* is provided in a left side end portion (alternatively in a right side end portion or in each of the left and right side end portions) of the shutter face portion 41*a* so as to project toward the side (front side) where the spacer portion 41*c* will face the ink cartridge 7. The spacer portion 41*c* prevents the shutter face portion 41*a* from directly contacting with the insertion-side wall surface of the ink cartridge 7.

The lock member 42 is supported on the lower side of the lower partition plate 2*a* rotatably around a shaft 42*a*. The lock member 42 is urged by a not-shown spring so that a presser plate 42*b* rising from one end of the lock member 42 follows the surface of the shutter face portion 41*a* on the ink needle 26 side. In addition, the lock member 42 has an unlocking operation piece 43 integrally between the shaft 42*a* and the presser plate 42*b*. Due to the urging force of the aforementioned spring, the unlocking operation piece 43 projects upward from an opening formed in the lower partition plate 2*a*.

Figure 8:
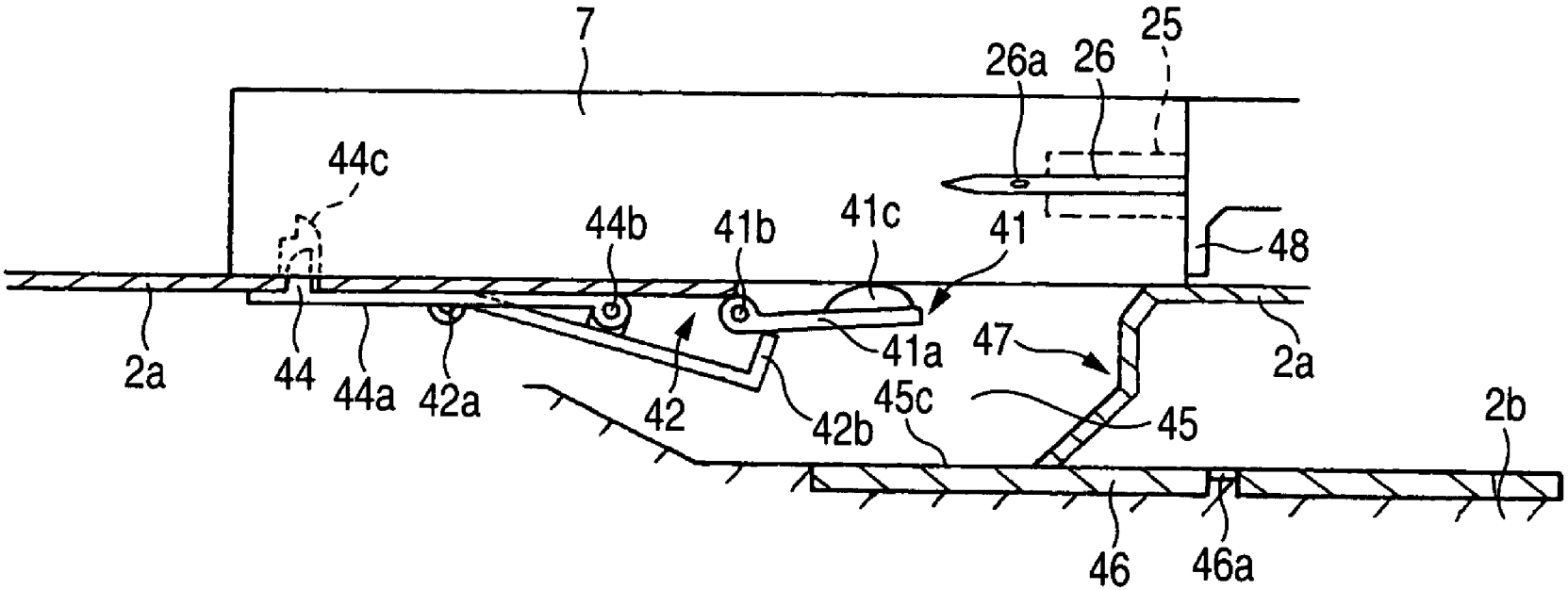
FIG. 8 is a longitudinally sectional view showing the state where the ink cartridge has been attached to the cartridge mounting portion.

The detachment preventing lock protrusion portion 44 provides resistance against the urging force applied to estrange the mounted ink cartridge 7 from the ink needle 26. The detachment preventing lock protrusion portion 44 is provided integrally with a detachment preventing lock member 44*a* so as to project upward from an opening formed in the lower partition plate 2*a*. The detachment preventing lock member 44*a* is supported on the lower surface of the lower partition plate 2*a* rotatably around a shaft 44*b*, and urged upward by a not-shown spring. Normally the detachment preventing lock protrusion portion 44 is made to project upward from the opening so as to be fitted into a detachment preventing lock recess portion 44*c* (see FIG. 8) of the ink cartridge 7 located in the mounting position. However, when the ink cartridge 7 abuts against the detachment preventing lock protrusion portion 44 due to the force applied for removing the ink cartridge 7, the detachment preventing lock member 44*a* rotates around the shaft 44*b*. Thus, the detachment preventing lock protrusion portion 44 takes shelter under the lower partition plate 2*a* so as to allow the ink cartridge 7 to be removed.

Thus, the detachment preventing lock protrusion portion 44, the unlocking operation piece 43, the spacer portion 41*c*, the shutter face portion 41*a* and the presser plate 42*b* are disposed on the lower partition plate 2*a* in that order from the front side to the ink needle 26 side.

Incidentally, assume that an external force acts on the shutter member 41 without pressing the unlocking operation piece 43. In this event, since the presser plate 42*b* abuts against the back side of the shutter face portion 41*a*, the shield of the ink needle 26 is not released. Thus, there is no fear that the ink needle 26 is exposed to the front side.

The opening of the shelter port 45 is provided in the lower partition plate 2*a* as described previously. Then, as shown in FIG. 5, a second lower partition plate 2*b* is provided under the lower partition plate 2*a* and in parallel therewith. The second lower partition plate 2*b* forms a bottom surface 45*c* of the shelter port 45. In addition, the portion corresponding to the shoulder of the lower partition plate 2*a*, which is cut out in a U-shape in plan view for forming the shelter port 45, is formed into a downward bent shape forming the rear inner wall surface of the shelter port 45. Further, a member disposed between the lower partition plate 2*a* and the second partition plate 2*b* forms the other inner wall surface of the shelter port 45. Thus, the shelter port 45 is formed out of combination of a plurality of members and into a recess shape open at the top.

The shelter port 45 also serves as an ink outlet for collecting waste ink. To this end, as shown in FIG. 7, the shelter port 45 is provided at a position corresponding to and vertically under the ink needle 26, and formed to be open at least at the position corresponding to and vertically under the needle hole 26*a* of the ink needle 26. A front edge portion 45*a* of the opening of the ink outlet (shelter port) 45 is forward at an enough distance from the ink needle 26 to allow the shutter face portion 41*a* to fall down without abutting against the tip of the ink needle 26 when the shutter face portion 41*a* takes shelter. In addition, a rear edge portion 45*b* of the opening of the ink outlet (shelter port) 45 is formed near a base 26*b* of the ink needle 26 so that ink introduced to the base 26*b* side of the ink needle 26 drops down into the ink outlet (shelter port) 45. Then, a sheet-like ink absorber 46 having ink absorbency is disposed on the bottom surface 45*c* of the ink outlet (shelter port) 45 so as to absorb and hold waste ink flowing into the ink outlet (shelter port) 45.

In addition, a guide portion 47 for guiding ink to the ink absorber 46 is provided in the inner wall surface (rear inner wall surface) extending from the rear edge portion 45*b* to the bottom surface 45*c*. The guide portion 47 is formed in a stepped shape projecting downward and forward. Thus ink dropping on the inner wall surface of the guide portion 47 flows down quickly so as to be absorbed and retained in the ink absorber 46. The guide portion 47 may be formed with the lower partition plate 2*a* integrally. If so, it is hard to leak the ink flowing from the lower partition plate 2*a* to the ink absorber 46 through the guide portion 47. This is because the integral member of the guide portion 47 and the lower partition plate 2*a* has no joint.

Figure 6:
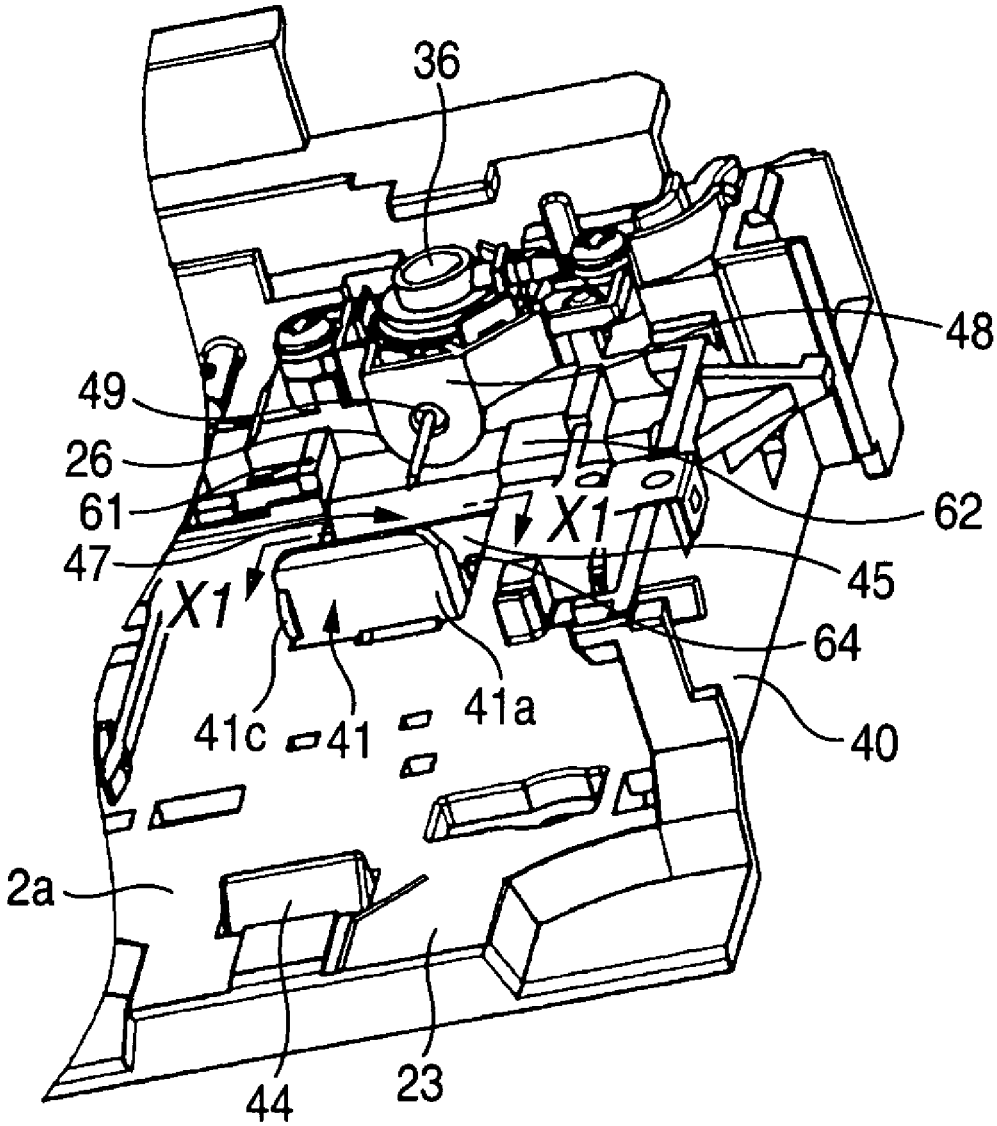
FIG. 6 is a perspective view of the cartridge mounting portion.

Further, a skirt member 48 by which the ink introduced to the base 26*b* side is guided to the guide portion 47 is attached to the base 26*b* of the ink needle 26. The skirt member 48 has a shape projecting downward and a semicircular shape on the lower side as shown in FIG. 6. Thus, the ink introduced to the skirt member 48 is collected in the projecting point of the semicircular shape looking down, so as to drop down onto the guide portion 47 easily. Incidentally, the shape of the skirt member 48 maybe formed into a triangular shape projecting downward or into a shape having a plurality of projecting points looking down.

Figure 9:
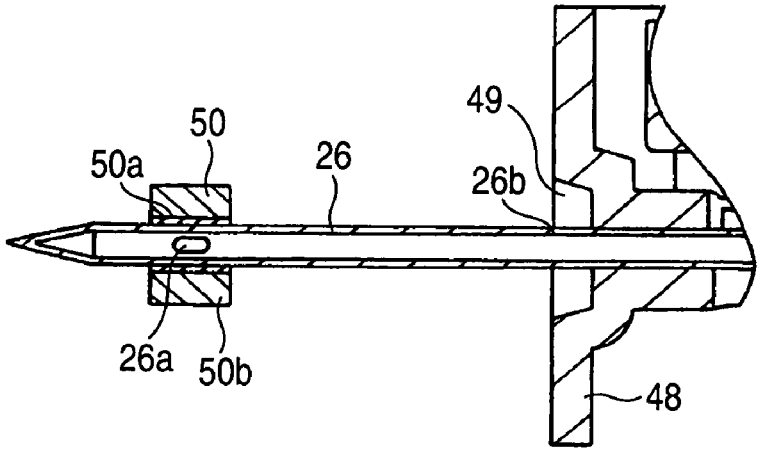
FIG. 9 is a sectional view showing the state where a needle hole of a needle member has been capped.
Figure 10:
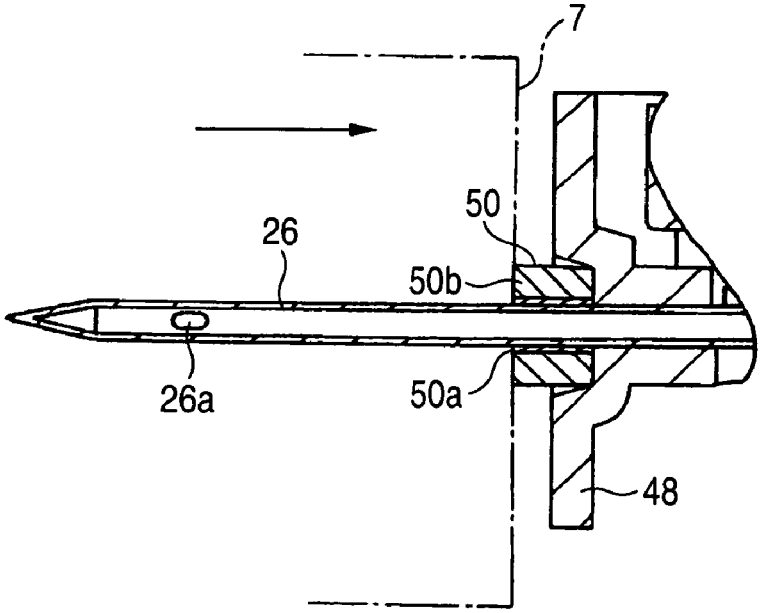
FIG. 10 is a sectional view showing the state where a member for capping the needle hole of the needle member therewith has slid onto a skirt member.

In the skirt member 48, as shown in FIG. 9, a ring-like recess portion 49 open to the tip side of the ink needle 26 is defined at a position facing the base 26*b* of the ink needle 26. In the recess portion 49, a second ink absorber 50 formed like a ring is received. The second ink absorber 50 includes a non-absorbing material 50*a* in its inner circumferential surface. The other portion of the inner circumferential surface is made from an ink absorbing material 50*b* similar to that of the ink absorber 46. The second ink absorber 50 is attached at a position where the second ink absorber 50 closes the needle hole 26*a* of the ink needle 26 till the ink cartridge 7 is loaded for the first time after shipment. As shown in FIG. 10, the second ink absorber 50 is thrust into the recess portion 49 by the insertion-side wall surface of the ink cartridge 7 in accordance with the operation for loading the ink cartridge 7 for the first time. Liquid for preventing the ink channel from the ink needle 26 to the recording head unit 10 from drying is introduced into the ink channel at the time of shipment. It has been therefore hitherto necessary to provide a capping member for preventing the liquid from leaking from the needle hole 26*a* of the ink needle 26. Accordingly, only the inner circumferential surface of the second absorber 50 is made from the non-absorbing material 50*a* while the second absorber 50 is slid in accordance with the operation for attaching the ink cartridge 7. Thus, the capping member for closing the needle hole 26*a* can serve as the member for absorbing ink in the base 26*b* of the ink needle 26.

Incidentally, according to another embodiment of the invention, a ring-like member made from only a non-absorbing material (for example, silicon rubber) maybe provided in place of the second absorber 50. In this case, the ring-like member is attached as a capping member to the position where the ring-like member closes the needle hole 26*a* at the time of shipment. The ring-like member is thrust into the recess portion 49 by the insertion-side wall surface of the ink cartridge 7 in accordance with the operation for loading the ink cartridge 7 for the first time. Although the ring-like member received in the skirt member 48 cannot absorb ink, the ring-like member serves as a path for introducing the ink downward.

In addition, in this embodiment, as shown in FIG. 4, four ink needles 26 are disposed in parallel for the four color inks to be used, and four shelter ports 45 also serving as ink outlets as described above are disposed in parallel and correspondingly to the four ink needles 26. Each ink outlet (shelter port) 45 uses the second lower partition plate 2*b* as the bottom plate 45*c* as shown in FIG. 5. In this event, the four ink outlets (shelter ports) 45 share the second lower partition plate 2*b* as the bottom surfaces 45*c* thereof. That is, the lower partition plate 2*a* having four openings in parallel is disposed over the second lower partition plate 2*b* and in parallel therewith. Accordingly, the sheet-like ink absorber 46 to be disposed on the bottom surfaces 45*c* is laid to be long in the left/right direction so as to be shared among the four ink outlets (shelter ports) 45 as shown by the broken line in FIG. 4. By making the ink absorber 46 have a large area thus, the ink absorbing capacity is increased. Then, the rear edge portion of the ink absorber 46 is disposed between the lower side of a member constituting the guide portion 47 as the inner wall surface of the ink outlet (shelter port) 45 and the second lower partition plate 2*b*, and disposed to extend to a deeper position of the multi function device 1. Thus, the performance in absorbing the ink flowing down along the guide portion 47 is enhanced. In addition, the front edge portion of the ink absorber 46 is disposed in front of the needle hole 26*a* of the ink needle 26. Thus, the ink absorber 46 can also absorb ink dropping directly from the needle hole 26*a*.

In the ink absorber 46, as shown in FIG. 7, a hole 46*a* or a notch is provided correspondingly to the position of a protrusion (screw or the like) provided in the second lower partition plate 2*b*. Positioning is performed using the protrusion and the hole 46*a* or the notch. Alternatively, the edge portion of the ink absorber 46 may abut against another member so as to prevent positional displacement.

Incidentally, in this embodiment, the ink absorber 46 is shared by the four ink outlets (shelter ports) 45 as described above. Not to say, however, an ink absorber may be provided for each ink outlet (shelter port) 45 individually. In addition, the positions of the front and rear edge portions of the ink absorber 46 may be changed, or the ink absorber 46 may be disposed on the inner wall surface of each ink outlet (shelter port) 45.

Figure 11:
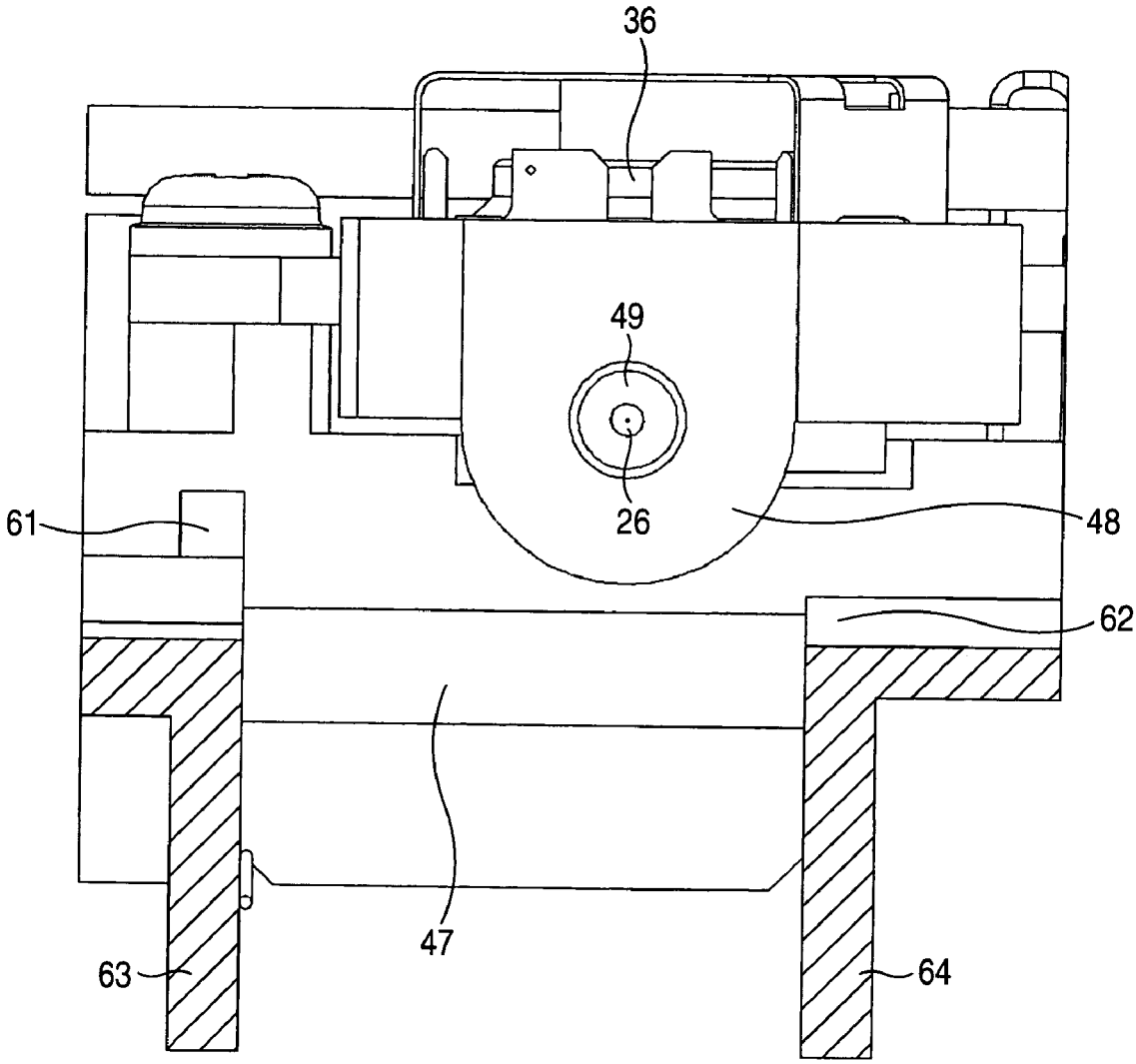
FIG. 11 is a front view of an ink needle.

FIG. 11 is a front view of the ink needle 26 and a partial section view taken along line XI—XI in FIG. 6. Projection walls 61 and 62 protrude from the lower partition plate 2*a* on both sides of the ink needle 26 and extend in a forward/rearward direction to be parallel to each other. The projection walls 61 and 62 shield the both sides of the ink needle 26. Therefore, even when ink flowing out from the ink needle 26 spatters in the right and left directions, the pollution of the inkjet printer 5 can be prevented. Further, side walls 63 and 64 are formed on both sides of the shelter port 45. The side walls 63 and 64 extend downward from the lower partition plate 2*a* to second lower partition plate 2*b*. Accordingly, even when the ink flowing out from the ink needle 26 drops in the right and left directions, the ink flows along each side wall 63, 64 and is absorbed by the ink absorber 46 disposed on the bottom surface 45*c* of the ink outlet (shelter port) 45. As a result, the pollution of the inkjet printer 5 can be prevented.

According to the configuration, first, when a user attaches an ink cartridge 7 to the cartridge mounting portion 23 for the first time after shipment, the user mounts the lower surface of the ink cartridge 7 on the lower partition plate 2*a* of the body casing 2 and slides the ink cartridge 7 rearward. Then, the lower surface of the cartridge 7 presses the detachment preventing lock protrusion portion 44 shown in FIG. 4, so as to retract the detachment preventing lock protrusion portion 44. After that, the detachment preventing lock protrusion portion 44 is retracted continuously while the cartridge 7 slides and advances as shown in FIG. 7. When the lower surface of the cartridge 7 steps on the unlocking operation piece 43, the lock member 42 unlocks the shutter member 41 (moves down the presser plate 42*b*). Successively, when the side end surface of the cartridge 7 on the ink needle 26 side abuts against the spacer portion 41*c* of the shutter member 41, the shutter face portion 41*a* suffers pressure. In this event, the presser plate 42*b* for preventing the shutter face portion 41*a* from rotating is absent from the back side of the shutter face portion 41*a*. Therefore, the shutter face portion 41*a* falls down to the shelter port 45 and takes shelter therein (see FIG. 8).

On the other hand, a capping member (second ink absorber) 50 is attached to the needle hole 26*a* of the ink needle 26 at the time of shipment in order to prevent leakage of liquid, which has been introduced into the ink channel for the purpose of preventing the ink channel from drying (see FIG. 9). Therefore, when the ink cartridge 7 is made to advance further, the tip of the ink needle 26 pierces the seal member 25 of the ink cartridge 7. In that state, the insertion-side wall surface of the ink cartridge 7 thrusts the capping member (second ink absorber) 50 rearward so that the capping member (second ink absorber) 50 is received in the recess portion 49 of the skirt member 48, and at the same time, the needle hole 26*a* reaches the inside of the ink reception chamber 24*a* (see FIGS. 8 and 10). Then, the pressure-contact pad 31 is urged to be in close contact with the air hole of the insertion-side wall surface of the cartridge 7. The detachment preventing lock protrusion portion 44 engages with the detachment preventing lock recess portion 44*c* of the cartridge 7 so that the cartridge 7 is locked. Thus, the cartridge 7 is prevented from being detached forward. In such a manner, the four color ink cartridges 7 are attached to the corresponding cartridge mounting portions 23 respectively.

When the ink cartridges 7 have been attached, the maintenance unit 11 sucks the liquid, which is introduced into the ink channel and prevents the ink channel from drying. Then, the ink in the ink reception chamber 24*b* is once supplied to the buffer tank 36 by the ink needle 26, and the ink is successively supplied from the buffer tank 36 to the recording head unit 10 through the ink supply tube 27 (27*a*–27*d*) so as to be used for recording operation.

Here, the location of the ink needle 26 is lower than the nozzle surface 29 in the recording head unit 10 by the head as shown in FIG. 5. Due to the head difference, negative pressure always acts on the ink in each nozzle 33. In this state, the ink is retained in the nozzle 33 against the negative pressure due to the surface tension of the meniscus of the ink formed in the nozzle. For example, in the maintenance operation, compressed air (positive pressure) is supplied to each air chamber 24*c* of each ink cartridge 7 by the air pump 28 so that the meniscus is prevented from being broken when the cap is removed.

A sensor detects the ink volume in the ink cartridge. When the remaining volume drops away, the user is prompted to exchange the ink cartridge 7. For the ink cartridge 7 to be removed, the reverse of the aforementioned mounting operation is done. When a force is applied to the ink cartridge 7 so as to pull the ink cartridge 7 to the front side, the ink cartridge 7 abuts against the detachment preventing lock protrusion portion 44 so that the detachment preventing lock member 44*a* rotates around the shaft 44*b*. Thus, the detachment preventing lock protrusion portion 44 is retracted under the lower partition plate 2*a*. After that, the ink cartridge 7 is pulled out forward as it is. Thus, the removal of the ink cartridge 7 from the cartridge mounting portion 23 is completed.

The capping member for closing the needle hole 26*a* at the time of shipment is no longer attached to the ink needle 26 from which the ink cartridge 7 has been removed. Accordingly, the pressure (head pressure) corresponding to the head difference H between the ink needle 26 and the nozzle surface 29 acts on the ink needle 26. Thus, when the cap covering the nozzle surface of the head is removed by mistake, ink remaining in the ink channel leaks from the needle hole 26*a*. A part of the leaking ink flows to the base 26*b* of the ink needle 26 along the ink needle 26, and is absorbed by the second ink absorber 50 received in the skirt member 48. Another part of the ink leaking from the needle hole 26*a* flows to the base 26*b* of the ink needle 26 along the ink needle 26, and is collected under the skirt member 48 along the downward projecting shape of the skirt member 48. Then, the ink drops down to th guide portion 47 (see the arrow A in FIG. 7). The ink dropping down on the guide portion 47 flows further down along the slope of the guide portion 47, and is absorbed by the ink absorber 46 disposed on the bottom surface 45*c* of the ink outlet (shelter port) 45. Further another part of the ink leaking from the needle hole 26*a* drops down vertically directly, and is absorbed by the ink absorber 46 (see the arrow B in FIG. 7).

In such a manner, when the cap is removed from the head in the state where the ink cartridge 7 has been removed, ink leaks out from the needle hole 26*a*, but the ink is absorbed by the ink absorber 46 or the second ink absorber 50 by any course. Thus, there is no fear that the ink pollutes the inside of the inkjet printer 5 or the like. Particularly since a large-area sheet-like member is used as the ink absorber 46, the absorbing capacity of waste ink is increased so that the reliability in preventing pollution is enhanced.

In addition, the ink cartridge 7 may be once removed and attached again not because the ink remaining volume drops away as described above but for some reason in spite that the ink remains to some extent. In such a case, ink often adheres to the insertion-side wall surface of the ink cartridge 7, particularly the surface thereof near the center of the seal member 25 to which the ink needle 26 has been inserted. When the ink cartridge 7 is attached again, the insertion-side wall surface of the ink cartridge 7 presses the shutter face portion 41*a*. Accordingly, the ink may adhere to and pollute the shutter face portion 41*a* when the insertion-side wall surface of the ink cartridge 7 presses the shutter face portion 41*a*. As a result, there is a fear that the ink adhering to the shutter face portion 41*a* is transferred from the shutter member 41 to the lower partition plate 2*a* or the like so that the inkjet printer 5 is polluted. However, according to the embodiment of the invention, this problem is avoided because the spacer portion 41*c* is provided to project from the shutter face portion 41*a*. That is, the insertion-side wall surface of the ink cartridge 7 abuts against the spacer portion 41*c* ahead on the side end portion side so as to press the shutter face portion 41*a*. Thus, there is no fear that the insertion-side wall surface of the ink cartridge 7 polluted with the ink is brought into direct contact with the shutter face portion 41*a*. In such a manner, pollution of another member with the ink is prevented.

Incidentally, description has been made on the assumption that the ink absorber 46 absorbs ink leaking when the ink cartridge 7 is absent from the ink needle 26. However, the ink absorber 46 can also absorb ink leaking when the ink needle 26 is inserted into the ink cartridge 7. Thus, pollution of the inside of the multi function device with the ink can be prevented.

In addition, the invention is applied to the multi function device 1 in the aforementioned embodiment. The invention is not limited thereto, but applicable to various kinds of equipment having an inkjet printer.

What is claimed is:

1. An inkjet printer, comprising:

a body casing;

a recording head which ejects ink to perform recording on a recording medium;

an ink cartridge which stores ink to be supplied to the recording head, and is attached to the body casing;

a hollow needle member which is provided in the body casing and allows the ink cartridge and the recording head to communicate with each other when the ink cartridge is thrust and attached to the body casing;

a support member which supports the ink cartridge attached to the body casing, and defines an ink outlet at least just below the needle member; and an ink absorber disposed at least on a bottom surface of the ink outlet, wherein:

the body casing includes a shutter member;

the shutter member shields the needle member when the ink cartridge is absent; and the shutter member takes shelter in the ink outlet to expose the needle member when the ink cartridge is attached.

2. The inkjet printer according to claim 1, wherein the support member includes a guide portion by which ink leaking from the needle member when the ink cartridge is absent is guided into the ink absorber.

3. The inkjet printer according to claim 2, further comprising a skirt member which is attached to a base of the needle member, and guides ink introduced to the base of the needle member to the guide portion.

4. The inkjet printer according to claim 2, wherein the ink absorber absorbs ink guided by the guide portion and ink dropping directly from the needle member.

5. The inkjet printer according to claim 3, further comprising a ring member which is made of a non-absorbing material; the ring member is attached to a position where the ring member closes a needle hole provided in a side surface of the needle member till the ink cartridge is attached for the first time; and slides to the base of the needle member in the skirt member in accordance with operation for attaching the ink cartridge for the first time.

6. The inkjet printer according to claim 3, further comprising a second ink absorber which absorbs ink introduced to the base of the needle member and is disposed in the skirt member.

7. The inkjet printer according to claim 6, wherein:

the second ink absorber has a ring shape;

the second ink absorber includes a non-absorbing material in an inner circumferential surface thereof;

the second ink absorber is attached to a position where the second ink absorber closes a needle hole defined in a side surface of the needle member till the ink cartridge is attached for a first time; and the second ink absorber slides to the base of the needle member in the skirt member in accordance with operation for attaching the ink cartridge for the first time.

8. The inkjet printer according to claim 1, wherein:

the needle member defines a needle hole which communicates inside of the needle member with inside of the ink cartridge when the ink cartridge is attached to the body casing; and the ink outlet is located at least just below the needle hole.

9. The inkjet printer according to claim 1, wherein the recording head is disposed higher than the needle member.

10. The inkjet printer according to claim 1, wherein:

the shutter member includes a shutter face portion which tilts from a position for shielding the needle member to a position for taking shelter when the shutter face portion suffers pressure due to operation for attaching the ink cartridge; and a spacer portion, which prevents the shutter face portion from being brought into direct contact with a needle-member-side wall surface of the ink cartridge, projects from a side end portion of the shutter face portion.

11. The inkjet printer according to claim 1 wherein:

the needle member comprises a plurality of needle members, which correspond to a plurality of colors and are arranged in parallel;

the ink outlet comprises a plurality of ink outlets, which correspond to the plurality of colors and are arranged in parallel; and the ink absorber is disposed over the bottom surfaces of the ink outlets.

12. The inkjet printer according to claim 1, wherein protrusion walls protrude from the support member and are located at positions corresponding to the needle member.

13. The inkjet printer according to claim 1, wherein side walls extend downward from the support member and shield both sides of the ink outlet.

14. The inkjet printer according to claim 1, wherein the needle member extends in a horizontal direction.

15. An inkjet printer, comprising:

a body casing;

a recording head which ejects ink to perform recording on a recording medium;

an ink cartridge which stores ink to be supplied to the recording head, and is attached to the body casing;

a hollow needle member which is provided in the body casing and allows the ink cartridge and the recording head to communicate with each other when the ink cartridge is thrust and attached to the body casing;

a support member which supports the ink cartridge attached to the body casing, and defines an ink outlet at least just below the needle member; and an ink absorber disposed at least on a bottom surface of the ink outlet, wherein protrusion walls protrude from the support member and are located at positions corresponding to the needle member.

16. An inkjet printer, comprising:

a body casing;

a recording head which ejects ink to perform recording on a recording medium;

an ink cartridge which stores ink to be supplied to the recording head, and is attached to the body casing;

a hollow needle member which is provided in the body casing and allows the ink cartridge and the recording head to communicate with each other when the ink cartridge is thrust and attached to the body casing;

a support member which supports the ink cartridge attached to the body casing, and defines an ink outlet at least just below the needle member; and an ink absorber disposed at least on a bottom surface of the ink outlet, wherein side walls extend downward from the support member and shield both sides of the ink outlet.

* * * * *